US005503053A

United States Patent [19]

Onishi et al.

[11] Patent Number: 5,503,053

[45] Date of Patent: Apr. 2, 1996

[54] SHEET MATERIAL CUTTING DEVICE

[75] Inventors: Takamasa Onishi; Zentaro Kamura; Hideo Yamato, all of Gumma, Japan

[73] Assignee: Onishilite Industry Co., Ltd., Gumma, Japan

[21] Appl. No.: 321,622

[22] Filed: Oct. 12, 1994

[30] Foreign Application Priority Data

Aug. 18, 1994 [JP] Japan ..... 6-194332

[51] Int. Cl.[6] ..... B26D 1/18; B26D 1/24

[52] U.S. Cl. ..... 83/488; 83/501; 83/578; 83/582; 83/614

[58] Field of Search ..... 83/485, 487, 488, 83/501, 578, 582, 614

[56] References Cited

U.S. PATENT DOCUMENTS

| | | | |
|---|---|---|---|
| 3,463,040 | 8/1969 | Pouilloux | 83/487 X |
| 3,766,816 | 10/1973 | Loveless | 83/508 X |
| 4,046,044 | 9/1977 | Paterson et al. | 83/508 X |
| 4,383,458 | 5/1983 | Kitai et al. | 83/488 X |
| 4,448,101 | 5/1984 | Templeton | 83/508 X |
| 4,665,787 | 5/1987 | Arnold et al. | 83/485 |
| 4,762,042 | 8/1988 | Denter et al. | 83/485 X |
| 5,042,349 | 8/1991 | Komatsu | 83/488 X |
| 5,307,716 | 5/1994 | Onishi et al. | 83/488 |

*Primary Examiner*—Eugenia Jones
*Attorney, Agent, or Firm*—Beveridge, Degrandi, Weilacher & Young

[57] ABSTRACT

A sheet material cutting mechanism for cutting sheet materials two rotary blades and a mechanism for pressing down a sheet material to be cut. When the motor is started, a screw shaft 2 rotates, and a rotary blade assembly 4 starts to move to the right in FIG. 1 . Then, the roller 12 rotates by friction with a frame 1, and a first rotary blade 10 rotates by the rotation of a roller. At the same time, a second rotary blade 20 also rotates by the frictional force generated between the rubber roller 22 and the frame 1. The sheet material, fed into the sheet material receiving portion 17, is pressed by the rubber roller 22 against the surface 5 of the frame 1 immediately before cutting to prevent lifting or bending of the sheet material, thereby producing satisfactory cutting of the sheet material.

2 Claims, 9 Drawing Sheets

SHEET MATERIAL CUTTING DEVICE

BACKGROUND OF THE INVENTION

The present invention relates to a sheet material cutting device to cut sheet material by the cooperation of two rotary blades which travel while rotating.

In a printer for a terminal such as an ECR or a POS, strip-shaped sheet material wound into a roll is pulled out for printing, and then the necessary portion is cut by a cutter into a sheet for delivery.

Various types of such sheet material cutting device are available. A rotary cutter requires high manufacturing costs and causes a relatively high degree of noise and, therefore, is now being replaced by a cutter featuring a combination of a circular rotary cutting blade moving while rotating and a fixed cutting blade formed into a long sheet.

The prior art sheet material cutting device of this type will be described below with reference to FIG. 8A and 8B. As shown in FIG. 8A, a supporting member 101 with a rotary blade 102 travels horizontally along a screw shaft 100. In FIG. 8B, the rotary blade 102 is rotatably bearing-supported on a shaft 104 mounted on the supporting member 101 and pressed against a fixed blade 103 by means of a spring 104. In FIG. 8A again, sheet material, fed in the vertical direction to the paper on which said figure appears, is cut by the rotary and the fixed blade as the supporting member travels horizontally.

With this type of cutting device, it is important, in order to cut the sheet material sharply, that the rotary blade 102 is slightly inclined toward the fixed blade 103 as shown in FIGS. 9 and 10, so that the periphery of the rotary blade 102 comes into contact with the edge of the stationary blade at a certain point P in the traveling direction of the rotary blade. Furthermore, when one wishes to cut a sheet material by both the forward and backward travel of the rotary blade 102, a means to switch the inclination of the rotary blade between the forward and backward travel is necessary. This type of device is actually proposed in, for example, the Japanese Examined Patent No. 50-24466/1975. The drawback of this device is that switching the rotary blade is complex and expensive because the rotary blade is switched for necessary inclination by using additional components such as a wire stretched horizontally or a lever oscillating around a pivot shaft.

To solve the above problems of conventional devices, the inventors of the present invention have already proposed a sheet material cutting device as described in U.S. Pat. No. 5,307,716. This device permits satisfactory cutting of strip-shaped sheet material such as paper by simply causing the rotary blade to incline by the angle necessary for cutting, in both the forward and the backward motion of the rotary blade, by the cooperation of the circular rotary blades moving while rotating, a roller for rotating the rotary blade, and a roller guide.

However, the above device has no mechanism to prevent lifting of the sheet material when it is being cut. Thus, sheet material would be lifted from the fixed blade or bent, thus preventing satisfactory cutting. Furthermore, depending on the contact between the rotary and the fixed blade, wearing of the cutting edge of the fixed blade is not always uniform over the entire length. This also prevents satisfactory cutting of the sheet material.

SUMMARY OF THE INVENTION

Against this background, the inventors of the present invention have improved the above-mentioned sheet material cutting device and have developed a sheet material cutting device with a new mechanism solving all of the above problems. This sheet material cutting device with the new mechanism permits cutting of sheet material by the cooperation of two rotary blades, and one of said two rotary blades, the one opposite to the frame, is provided with a rubber roller coaxially mounted on its shaft to press the sheet material to be cut against the frame. This device permits satisfactory cutting of sheet material by the cooperation of the two rotary blades, and the sheet material to be cut is pressed against the frame by the above-mentioned rubber roller immediately before the sheet material is cut, so that the sheet material to be cut is prevented from lifting or bending when it is cut, thereby assuring a sharp cut of the sheet material.

For this reason, the first technical solution adopted by the present invention is a sheet material cutting device wherein a sheet material cutting means comprises: a rotary blade supporting member slidably mounted on a frame; a first and a second rotary blade mounted on said supporting member; a spring member to keep the cutting edges of both said rotary blades pressed against each other; and a driving mechanism to rotate said first and second rotary blades by the movement of said rotary blade supporting member, and designed to cut a sheet material by the cooperation of said first and second rotary blades while said sheet material cutting means moves along said frame.

The second technical solution adopted by the inventors of the present invention is a sheet material cutting device with a sheet material cutting means comprising a rotary blade supporting member slidably mounted on a frame; a first and a second rotary blade mounted on said supporting member; a spring member to keep the cutting edges of both said rotary blades pressed against each other; and a driving mechanism to rotate said first and second rotary blades by the movement of said rotary blade supporting member; wherein said driving mechanism to rotate the rotary blades comprises a roller mounted between said frame and the first rotary blade in contact with both the frame and the first rotary blade, and a rubber roller mounted coaxially with the second rotary blade having a larger diameter than that of the second rotary blade and pressed against said frame.

BRIEF DESCRIPTION OF THE DRAWINGS

FIG. 7A is a cross-sectional view of section D—D in FIG. 7B. FIG. 7B is a plane view of FIG. 7A.

PREFERRED EMBODIMENT OF THE INVENTION

Figures 1A, 1B:
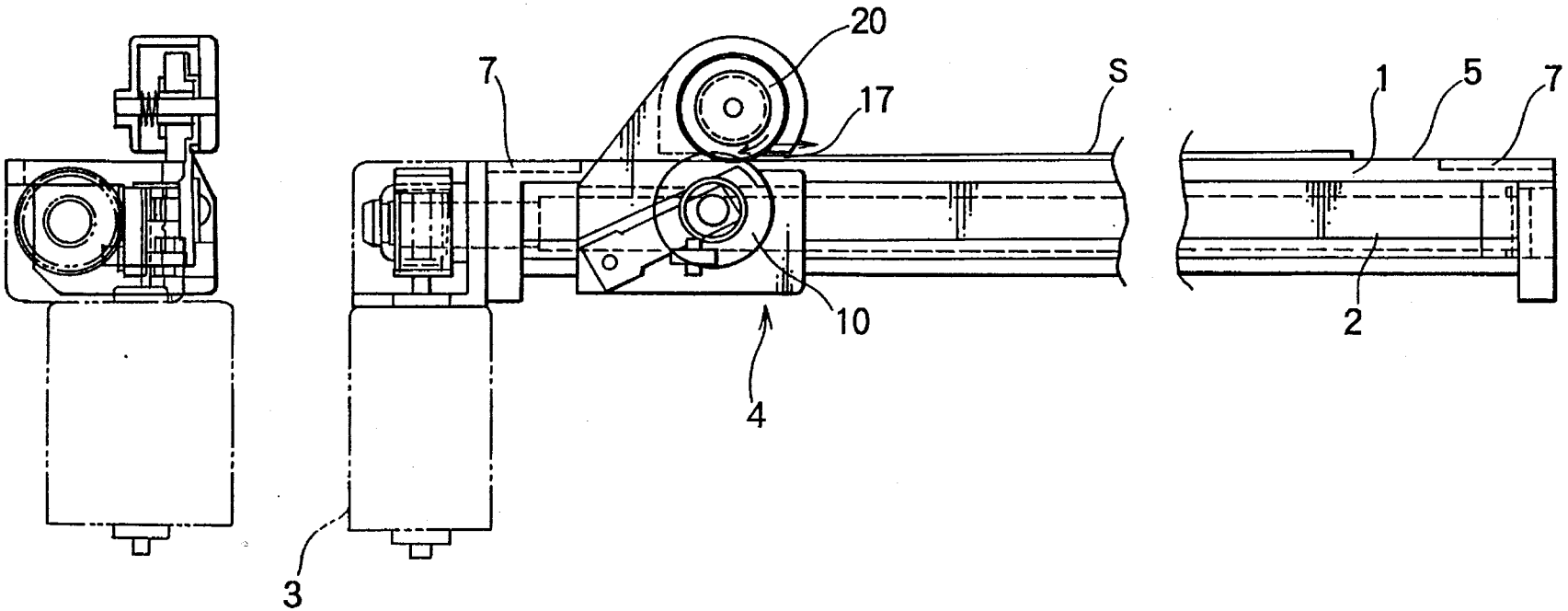
FIGS. 1A and 1B are general views of the sheet material cutting device of the present invention.

In FIGS. 1A and 1B, when the motor in the drive unit starts and the screw shaft 2 rotates, the sheet material cutting mechanism 4 moves to the right; the roller 12 rotates by the frictional force with the frame 1; and the first rotary blade rotates as the roller 12 rotates. Simultaneously, the second rotary blade 20 rotates by the frictional force between the rubber roller 22 and the frame 1. As a sheet material enters the sheet material receiving portion 17, the rubber roller 22 presses the sheet material, immediately before cutting, against the surface 5 of the frame 1 to prevent lifting or bending of the sheet material, with the result that the sheet material is cut by the cooperation of the two rotary blades 10 and 20. The two rotary blades 10 and 20 are pressed against each other by a certain spring force by springs 16 and 24, respectively, with the result that the sheet material is cut satisfactorily.

In the stand-by state, the sheet material cutting mechanism 4 is always at either end of the frame 1 under the control of driving motor. In the stand-by position, the rubber roller 22 rests on a recess 7 formed on the frame 1 to prevent permanent deformation.

The first embodiment of the present invention is described below with reference to the drawings.

FIG. 1A is a plan view and FIG. 1B is a side view of a sheet material cutting device as the first embodiment of the present invention.

In FIG. 1A, frame 1 supports a screw shaft 2 at both ends. A driving device 3 is mounted on one end of the screw shaft 2 to rotate the screw shaft 2. The driving device 3 comprises a motor and a transmission mechanism to transmit the rotational force of the motor to the screw shaft 2.

A sheet material cutting mechanism 4 is thread-engaged with the screw shaft 2. The sheet material cutting mechanism 4 is slidably supported by the guide on the frame without "play," as will be described later. In this first embodiment, the motor starts; the screw shaft 2 rotates; and the sheet material cutting mechanism 4 moves to the right in FIG. 1A to permit cutting of the sheet material between the two rotary blades. The sheet material cutting mechanism 4 returns to the waiting position without cutting a sheet material when the screw shaft 2 rotates reversely. The horizontal reciprocation of the sheet material cutting mechanism 4 is actuated by rotating the screw shaft 2 back and forth by the forward and reverse rotation of the motor or, by switching the transmission mechanism. Alternatively, the sheet material cutting mechanism 4 can reciprocate along the screw shaft 2, without changing the direction of motor rotation, by using continuous right- and left-hand threads on the screw shaft 2.

The above-mentioned sheet material cutting mechanism 4 is provided with two rotary blades (with a construction described later) to cut sheet material between them and a rotary blade supporting member to hold said rotary blades.

The construction of the above sheet material cutting mechanism 4 is described below.

Figure 2:
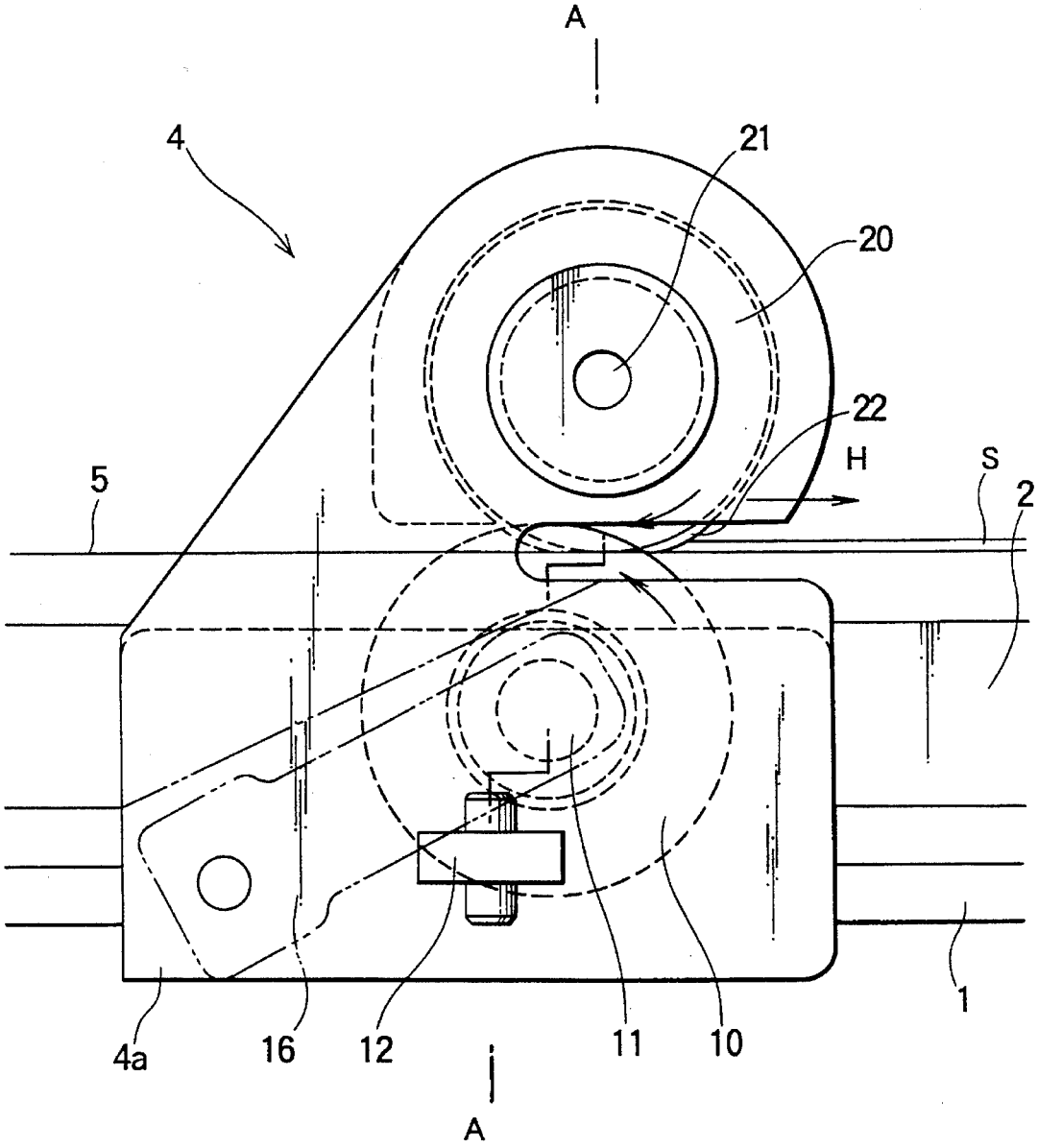
FIG. 2 is a plan view of the sheet material cutting device as the first embodiment of the present invention.
Figure 3:
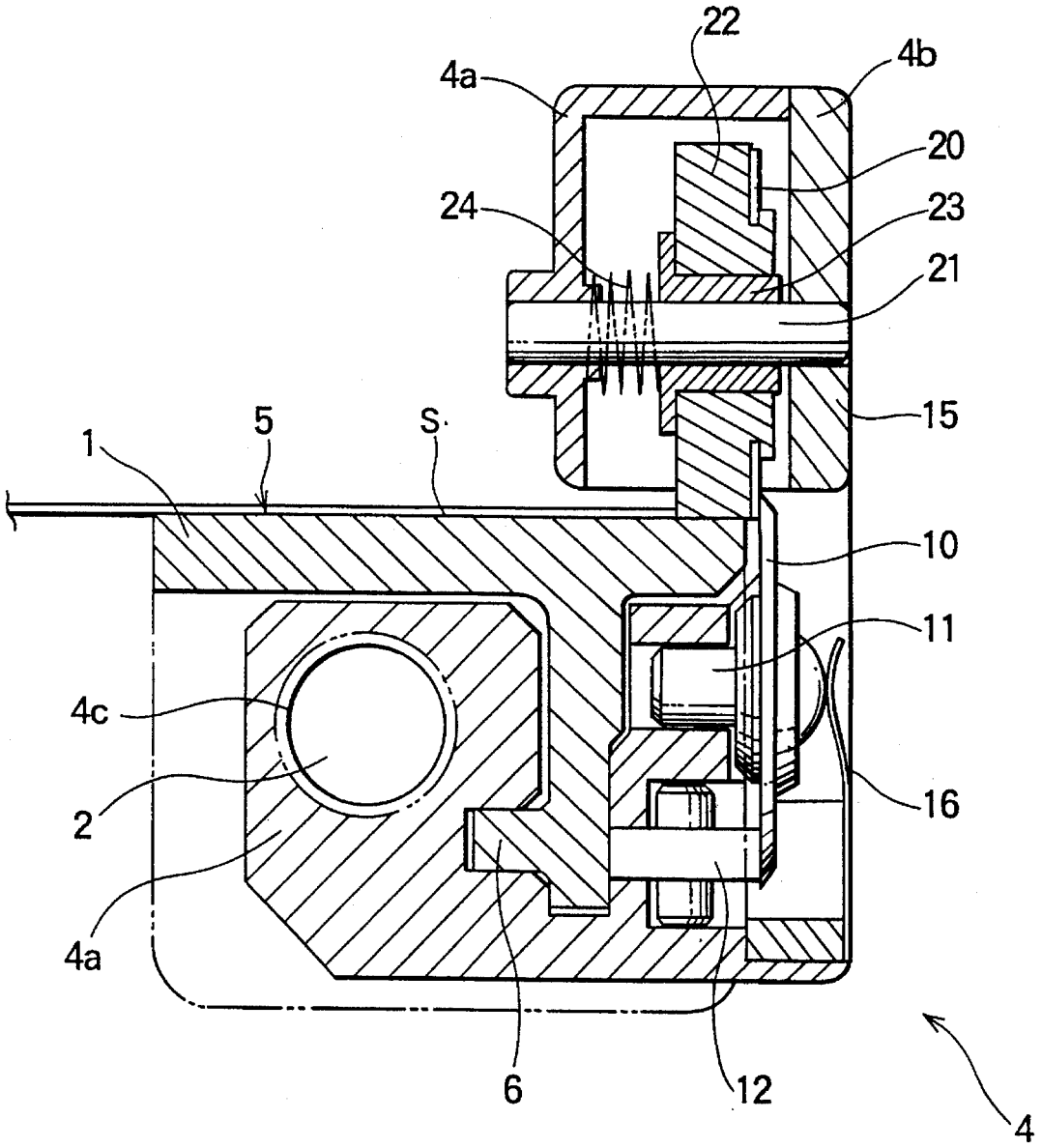
FIG. 3 is a cross-sectional view of section A—A in FIG. 2.
Figure 4B:
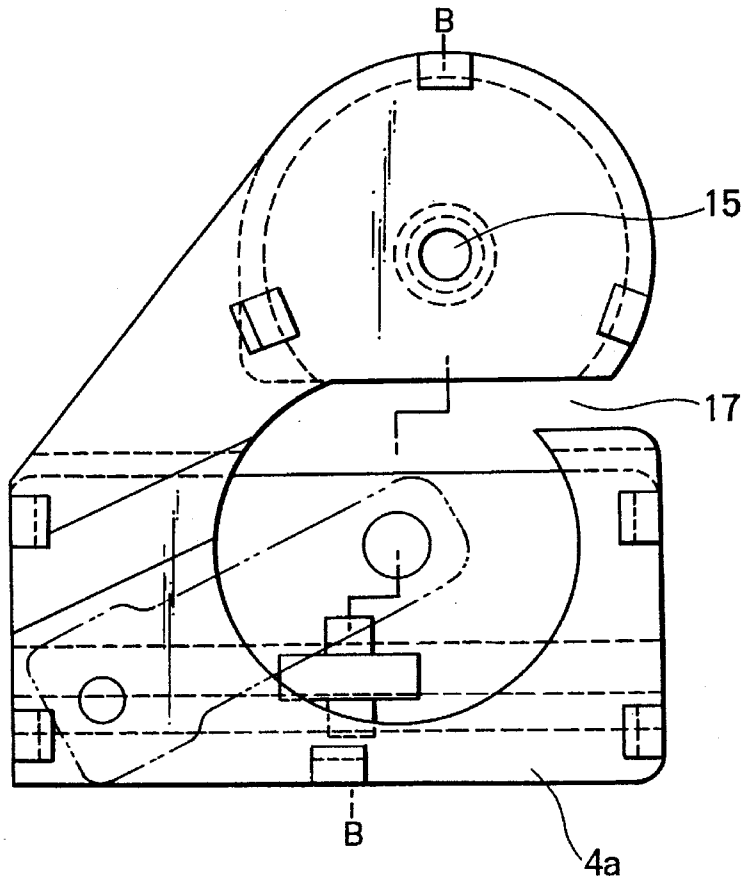
FIG. 4B is a plane view of FIG. 4A.

FIG. 2 is a plan view of the sheet material cutting means. FIG. 3 is a cross-sectional view of the section A—A in FIG. 2. FIG. 4B is a plan view of the rotary blade supporting member and FIG. 4A is a cross-sectional view of the section B—B in the plan view.

In FIG. 2, 1 frame 1 supports, as described earlier, the screw shaft 2 at both ends. The frame 1 has a cross section as shown in FIG. 3. It has a surface 5 on which the sheet material to be cut is placed, and a guide 6 for guiding the rotary blade supporting member 4*a*. The frame 1 further has a recess 7 on each end as shown in FIG. 1 to prevent permanent deformation of the rubber roller (described later) when it is in the rest position. The recess 7 is provided to release the rubber roller and prevent permanent deformation when the rotary blade supporting member 4*a* is situated at the end of the frame 1. When the rotary blade supporting member 4*a* is positioned at either end of the frame 1, the rubber roller rests on the recess 7 formed on the frame 1 and is released from deformation.

Figure 4A:
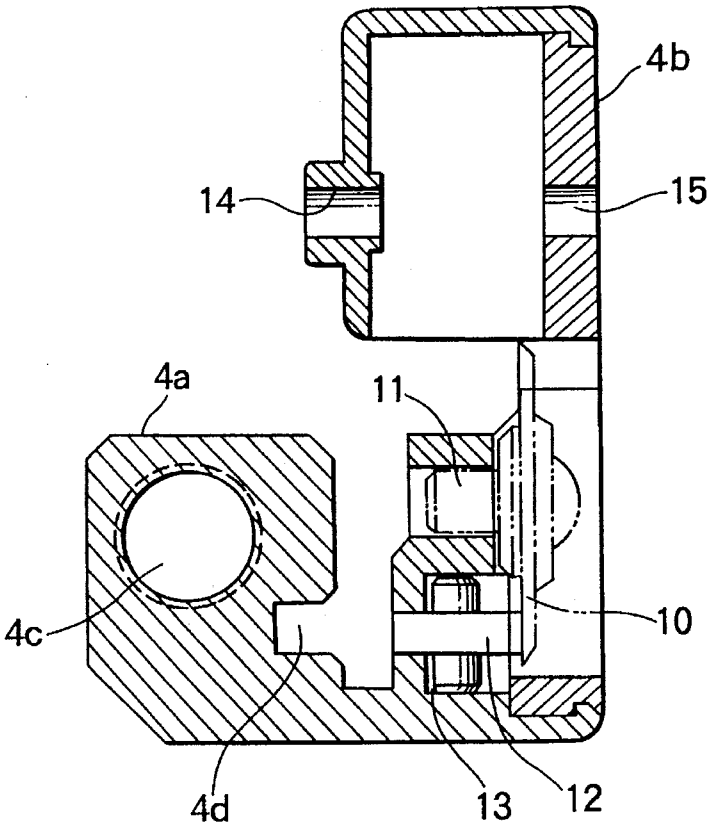
FIG. 4A is a cross-sectional view of section B—B in 4B.

FIGS. 4A and 4B show the rotary blade supporting member 4*a* which is slidably mounted on the above-mentioned frame 1.

In FIGS. 4A and 4B the rotary blade supporting member 4*a* comprises an integrally formed supporting member 4*a* and a cover 4*b* fitted to the supporting member 4*a*. As shown in the figure, the rotary blade supporting member 4*a* provides a threaded portion 4*c* to thread-engage itself with the above-mentioned screw shaft and a guide groove 4*d* which slidably fits onto the guide 6 of the frame 1. A bearing to hold the shaft 11 of the first rotary blade 10 is formed on the upper side (to the right in the figure) of the guide groove 4*d*. The above-mentioned rotary blade supporting member 4*a* further provides a space 13 to accommodate a roller which causes the first rotary blade 10 to rotate.

The roller 12, which is accommodated in the space 13 and placed between the frame 1 and the first rotary blade 10, maintains contact with the upper surface of the guide 6 of the frame and with the back side of the first rotary blade 10. When the rotary blade supporting member 4*a* travels along the frame 1, the roller 12 rotates due to frictional force with the guide 6 on the frame. The first rotary blade 10 also rotates due to frictional force as the roller 12 rotates.

A bearing 14 is provided through the wall of the above-mentioned rotary blade supporting member 4*a* to support the second rotary blade 20. A cover 4*b* with a bearing hole 15 can be mounted opposite to the bearing 14. Further, the rotary blade supporting member 4*a* is provided with a sheet material receiving portion 17.

Rotary shafts 11 and 21 for the first and the second rotary blades 10 and 20, respectively, are mounted on the rotary blade supporting member 4*a* of the above construction as shown in FIGS. 2 and 3. The first rotary blade 10 is pressed in the shaft direction (to the left in the figure) by a plate spring. The shaft 11 for the first rotary blade 10 is mounted loosely so that it is at a slight incline with reference to the rotary blade supporting member 4*a*. The roller 12 located between the first rotary blade 10 and the frame guide 6 is pressed against the surface of the frame guide 6 by the spring force of the above-mentioned plate spring 16 via the first rotary blade 10. In other words, the roller 12 is supported by the first rotary blade 10 and the surface of the frame guide 6 when assembled, as shown in FIG. 3. As a result of this construction, when the screw shaft 2 rotates and the rotary blade supporting member 4*a* moves, the roller 12 rotates due to frictional contact with the frame 1, and the rotating force of the roller 12 is transmitted to the first rotary blade 10 to cause it to rotate. It is desirable to keep the back side of the first rotary blade 10, the roller surface, and that area of the guide surface 6 of the frame that is in contact with the roller in a state that is suitable for producing an adequate frictional force.

The second rotary blade 20 and the rubber roller 22 are mounted on a bearing 23. The bearing 23 is rotatably and slidably mounted on a shaft 21. The shaft 21 is supported by the rotary blade supporting member 4*a* and the hole 15 through the cover 4*b*. The outside diameter of the rubber roller 22 is larger than that of the second rotary blade 20. This is necessary for the rubber roller 22 to press by deforming the sheet material S against the surface 5 of the frame 1 when the sheet material cutting mechanism 4 moves (see FIG. 2).

The second rotary blade 20 and the rubber roller 22 are pressed to the right in FIG. 3 by a spring 24, with the result that the back side of the first rotary blade 10 and the front surface of the second rotary blade 20 come into contact with each other under appropriate contact pressure. The rubber roller 22 is integrally constructed with the second rotary blade 20 in the present embodiment but these may be separate components. Further, the spring 24, pressing the second rotary blade 20 upward may be different from what is shown in the figure; various other types of springs may be used provided the same function is achieved.

The first and the second rotary blade 10 and 20 are assembled into the rotary blade supporting member of the above construction as shown in FIGS. 2 and 3, making up the sheet material cutting mechanism 4. In this instance, the shaft 11 of the first rotary blade 10 is mounted slightly behind in the cutting direction as shown in FIG. 2. This is necessary to make the sheet material receiving portion 17 formed on the rotary blade supporting member longer.

The operation of the sheet material cutting device as the first embodiment of the present invention is described below.

In FIG. 1A, assume the sheet material cutting mechanism 4 moves to the right along the frame 3. The motor (not shown) starts; the screw shaft 2 starts to rotate; the sheet material cutting mechanism 4 starts to move to the right; the roller 12 rotates by the frictional force between said roller and the frame 1, and the first rotary blade 10 starts to rotate as the roller 12 rotates. At the same time, the second rotary blade 20 rotates by the frictional force between the rubber roller 22 and the frame 1. The sheet material to be cut enters the sheet material receiving portion 17. In this instance, the sheet material is pressed against the surface 5 of the frame 1 by the rubber roller 22 immediately before cutting so that the sheet material will not be lifted or bent but will be satisfactorily cut by the cooperation of the two rotary blades 10 and 20. The two rotary blades 10 and 20 are in contact with each other under a specified force applied by springs 16 and 24, respectively, permitting satisfactory cutting of the sheet material.

In the present embodiment, the motor is controlled so that the sheet material cutting mechanism 4 will always rest on either end of the frame 1 in the waiting state of the device. In the waiting position, the rubber roll 22 rests on a recess 7 formed on the frame 1 to prevent permanent deformation.

The second embodiment of the present invention is described below referring to drawings.

The above first embodiment cuts the sheet material only when the sheet material cutting mechanism moves in one direction. With the second embodiment, on the other hand, the sheet material is cut by both the forward and backward travel of the sheet material cutting mechanism.

Like the first embodiment, the second embodiment also has a construction so that the sheet material cutting mechanism 30 travels along a screw shaft 2 mounted on the frame 1. Like the first embodiment again, the frame 1 has a recess to prevent permanent deformation of the rubber roller (described later) when the device rests on either end of the frame 1.

The structure of the sheet material cutting mechanism of the second embodiment is described below.

Figure 5:
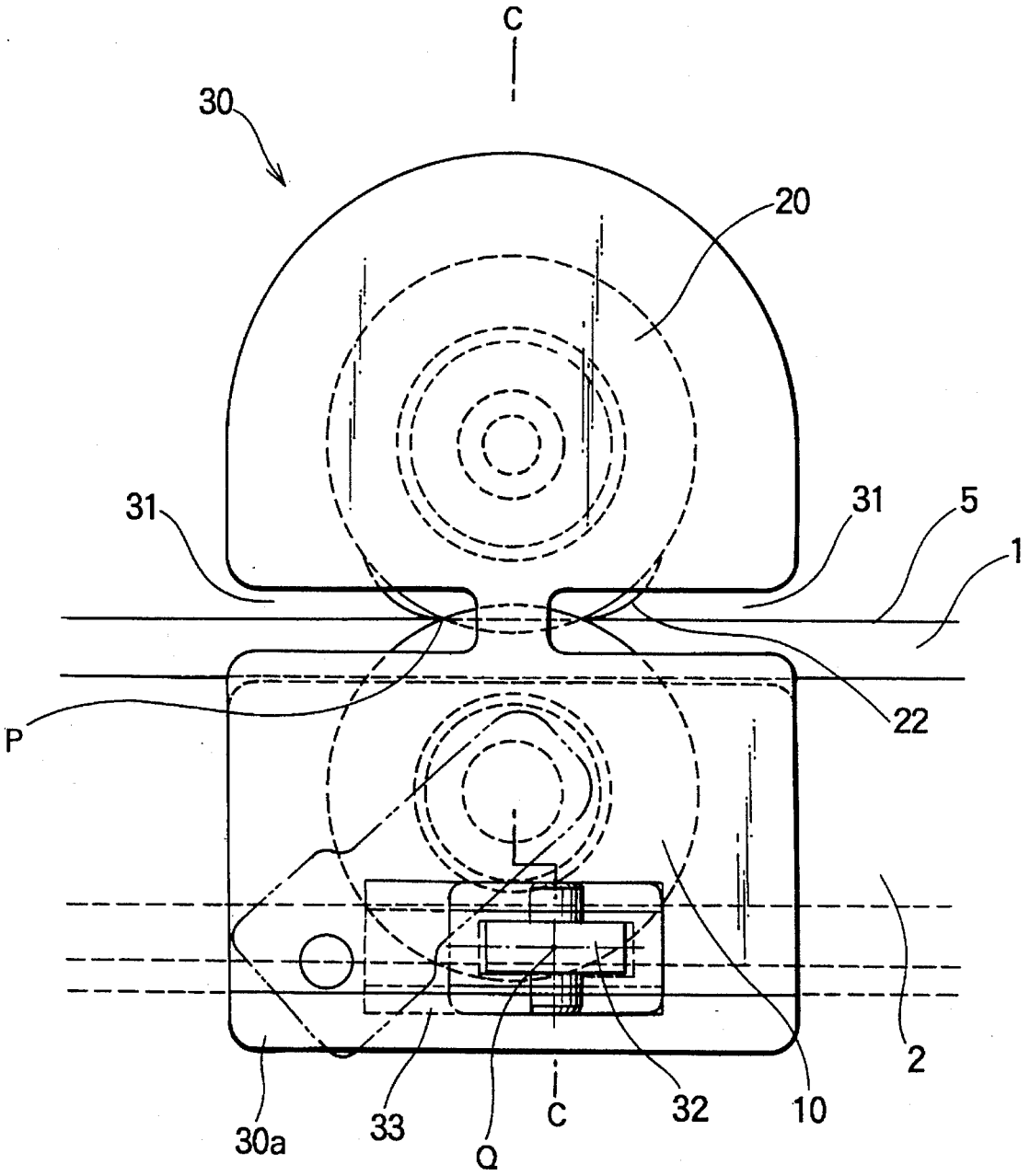
FIG. 5 is a plan view of the sheet material cutting mechanism of the second embodiment of the present invention.
Figure 6:
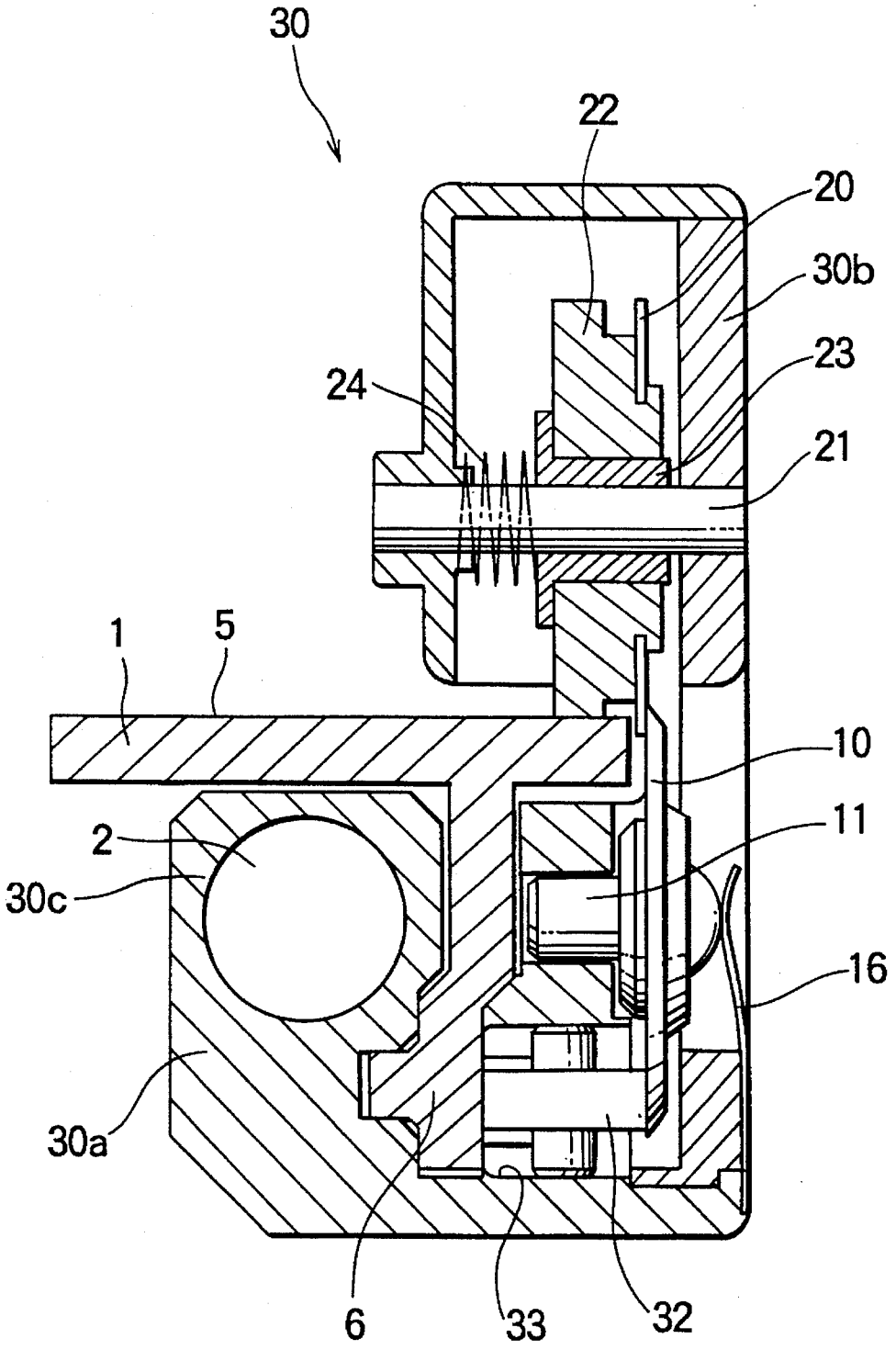
FIG. 6 is a cross-sectional view of section C—C in FIG. 5.
Figure 7B:
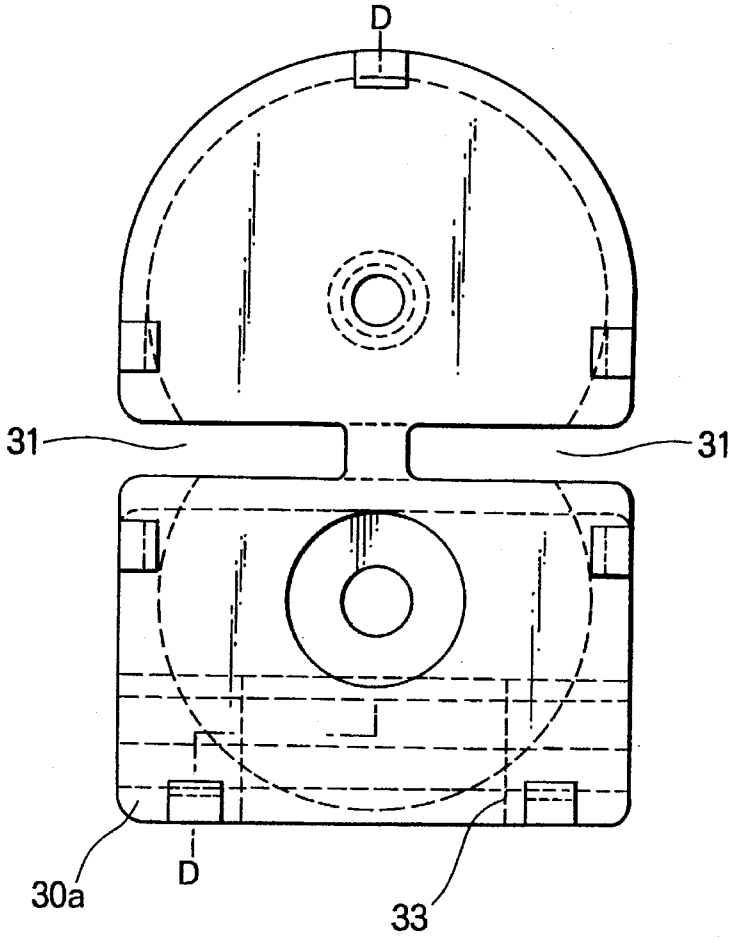
FIGS. 7A and 7B are views showing the rotary blade supporting member of the second embodiment.

FIG. 5 is a plan view of the sheet material cutting means. FIG. 6 is a sectional view of section C—C in FIG. 5. FIG. 7B is a plane view of the rotary blade supporting member and FIG. 7A is a cross-sectional view of section D—D in FIG. 7B.

In the figure, frame 1 supports the screw shaft 2 at both ends as described before. The frame 1 and the screw shaft 2 have the same construction as that in the first embodiment.

Figure 7A:
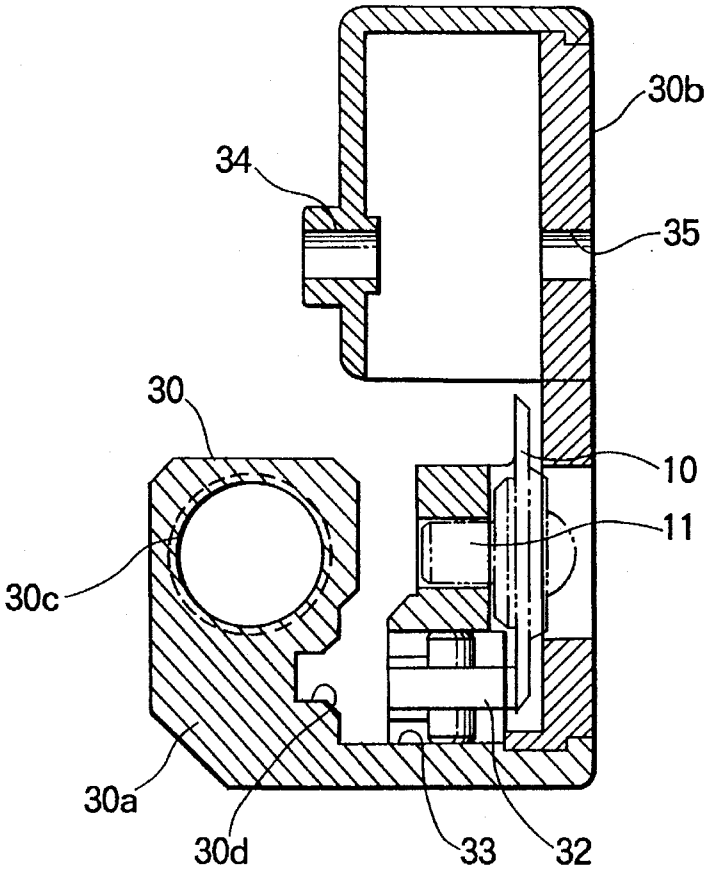
Figure 8B:
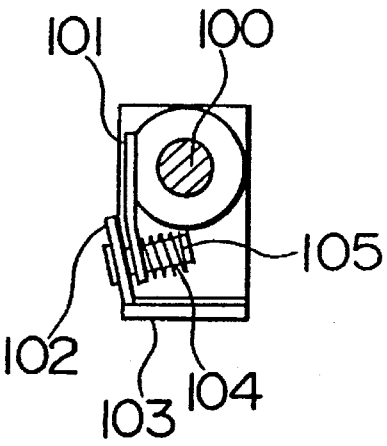
PRIOR ART FIG. 8B
FIGS. 8A and 8B are schematic views of a prior art sheet material cutting mechanism.
Figure 8A:
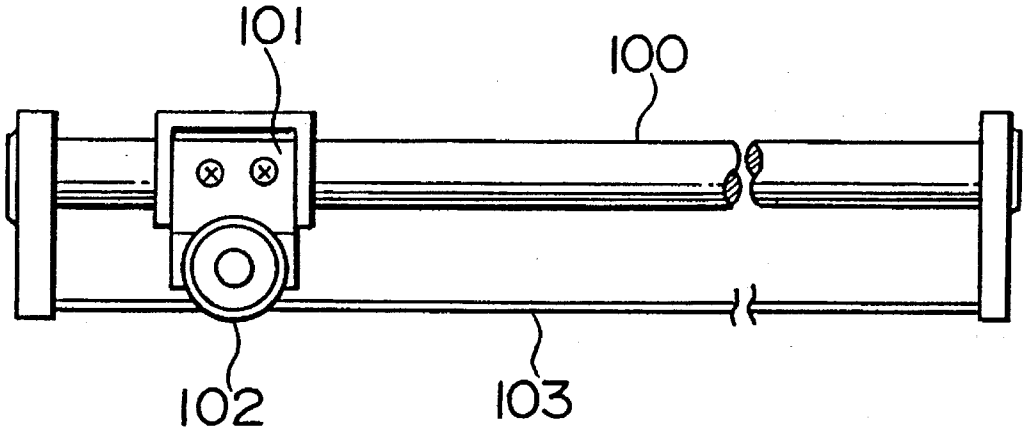
PRIOR ART FIG. 8A
Figure 9:
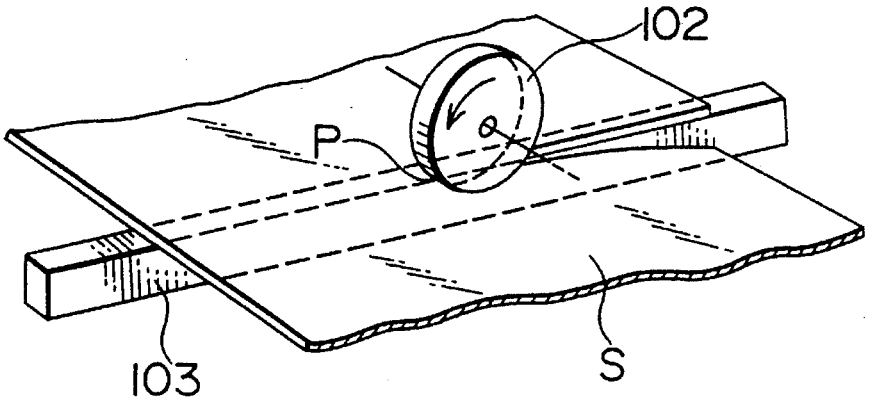
PRIOR ART FIG. 9
FIG. 9 is a descriptive drawing illustrating the operation of the rotary blades of a prior art sheet material cutting device.
Figure 10:
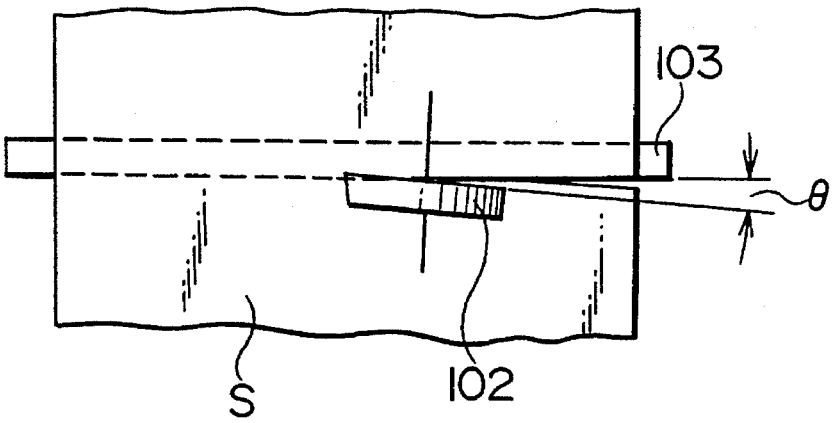
PRIOR ART FIG. 10
FIG. 10 is a plan view illustrating the operation of the rotary blades of a prior art sheet cutting device.

FIGS. 7A and 7B show the rotary blade supporting member 30*a* which is slidably mounted on the frame 1.

In the figure, the rotary blade supporting member 30*a* comprises an integrally formed rotary blade supporting member 30*a* and a cover 30*b* which is fitted to said rotary blade supporting member 30*a*. The rotary blade supporting member 30*a* has a threaded portion 30*c* for engagement with the screw shaft 2, and a guide groove 30*d* to which the guide 6 of the frame is slidably mounted as shown in the figure. Sheet material guides 31, 31 are symmetrically formed in the horizontal direction. A bearing to hold the shaft 11 of the first rotary blade 10 is provided above (to the right in the figure) the guide groove 30*d*. The rotary blade supporting member 30*a* also provides a roller groove 33 to accommodate a roller 32 (described later). The roller 32, accommodated in the roller groove 33, is placed between the frame 1 and the first rotary blade 10; is in contact with the upper surface of the guide 6 of the frame and the back side of the first rotary blade; rotates the first rotary blade 10 by frictional force; and causes the first rotary blade to incline.

The rotary blade supporting member 30*a* also provides a bearing 34 to support the second rotary blade 20. A cover 30*b* with a bearing hole 35 is mounted opposite to this.

The first and the second rotary blades 10 and 20 are assembled into the rotary blade supporting member 30*a* with the above construction as shown in FIGS. 5 and 6. It is important in this instance that the cutting edge of the first and the second rotary blades 10 and 20 be exposed from the sheet material guide 31.

In the assembled state, the first rotary blade 10 is pressed in the axial direction (to the left in FIG. 6) by a plate spring 16. The shaft 11 of the first rotary blade 10 is set loose so that it inclines to some extent with reference to the rotary blade supporting member 30*a*. A roller 32 is provided between the first rotary blade 10 and the frame 1. The roller 32 is used to slightly incline the first rotary blade forward. The roller 32 can move back and forth in the roller groove 33 toward the direction of movement of the rotary blade supporting member. Because of this mechanism, the first rotary blade 10 can be inclined forward while rotating (This mechanism is described in full detail in the Japanese Laid-Open Patent No. 5-200694/1993 (U.S. Pat. No. 5,307,716). The detailed explanation is omitted here because the above mechanism and principle is used as is).

The second rotary blade 20 and the rubber roller 22 are rotatably and slidably mounted on the shaft 21 of the second rotary blade 20 via a bearing 23. Further, said shaft 21 is supported by the rotary blade supporting member 30*a* and a cover 30*b*. The outside diameter of the rubber roller 22 is greater than that of the second rotary blade 20. This is necessary for the rubber roller 22 to firmly press, while being deformed, the sheet material to be cut against the surface 5 of the frame 1 when the sheet material cutting means 30 moves. The second rotary blade 20 and the rubber roller 22 are pressed to the right in FIG. 6 by a spring 24 as shown, with the result that the back side of the first rotary blade 10 and the upper side of the second rotary blade 20 come into contact with each other under appropriate pressure. In this embodiment, the rubber roller 22 is integrally constructed with the second rotary blade 20, but these may be separate components. Further, the spring pressing the second rotary blade 20 may be different from what is shown in the figure; various other types of springs may be used provided the same function is achieved.

The operation of the above sheet material cutting device with the above construction as the second embodiment is described below.

In FIG. 5, when the sheet material cutting mechanism moves to the left, the roller 32 moves in the roller groove 33 until it hits the stopper in said roller groove, or comes to the position shown by the solid lines in FIG. 5. By this motion of the roller 32, the first rotary blade 10 is supported by points P and Q. The rotary blade 10 is inclined forward by the rotation moment which is generated for the supporting axial line, with the result that the rotary blade 10 is pressed against the second rotary blade 20 at the contact point P.

As the sheet material cutting mechanism 30 continues to move to the left in this state along the frame 1, the roller 32 rotates by the friction with the frame guide, and the first rotary blade 10 also rotates with the rotation of the roller 32. In this way, the rotary blade 10 rotates while the sheet material cutting mechanism 30 moves to the left, and the second rotary blade 20 also rotates by the frictional force between the rubber roller 22 and the frame. The first rotary blade 10 comes into contact with the second rotary blade while the former is inclined, and the sheet material, located between the first and the second rotary blades, is cut by the cooperation of the two blades. When the sheet material has been cut and the sheet material cutting mechanism 30 has moved to the extreme end of the screw shaft 2, the sheet material cutting mechanism 30 maintains its state until the next sheet material is fed.

When the sheet material is supplied again, the screw shaft 2 rotates reversely by the motor (not shown). By this rotation, the sheet material cutting mechanism 30 starts to move in reverse, and cuts the sheet material in the same manner as described above. In this state, the first rotary blade 10 inclines in the reverse direction and moves while rotating in the direction of movement of the rotary blade supporting member while maintaining an appropriate degree of inclination in reference to the second rotary blade 20.

In the second embodiment of the present invention as described above, the rotary blade supporting member can cut the sheet material by both its forward and backward movement along the screw shaft. Further, the first rotary blade can be inclined at an appropriate angle against the second rotary blade in accordance with the direction of movement of the rotary blade supporting member, thereby enhancing the efficiency of cutting of sheet materials and producing a very sharp cut.

It is desirable to keep the back side of the first rotary blade, the roller surface, and that area of the surface of the frame 1 that is in contact with the roller in a state that is suitable for producing an adequate frictional force.

In this embodiment as well, the motor is controlled so that the rotary blade supporting member is always located at either end of the frame 1 in the waiting state of the system. In the waiting state, the rubber roller rests on a recess formed on the frame 1 to prevent permanent deformation.

The above second embodiment is the same as the first embodiment of the present invention in that (1) the inclination of the first rotary blade against the second rotary blade can be freely changed by changing the diameter of the roller 32, and (2) the sheet material cutting mechanism 30 can travel along the screw shaft 2 both forward and backward without changing the direction of motor rotation because the screw shaft 2 has continuous right- and left-handed threads.

The means to move the sheet material cutting mechanism back and forth is not limited to a screw shaft, but rather many other types such as belt and wire may be used.

In the first and the second embodiments, the first rotary blade 10 comes into contact with the upper surface of the second rotary blade. The reverse construction may also be used, that is, the second rotary blade 20 may come into contact with the upper surface of the first rotary blade. In this case, the direction of the springs for pressing the respective rotary blades is also reversed.

The present invention may be implemented in various other forms of embodiment without deviating from the spirit of the main features thereof. The above-mentioned embodiments are therefore only a few examples and should not be construed as limiting. All variations and alterations falling under the scope of equivalents to the patent claims come under the scope of the present invention.

As described in detail above, the sheet material cutting mechanism of the present invention cuts sheet material with a very simple construction comprising two rotary blades, and satisfactorily cuts a strip-shaped sheet material such as paper by simply inclining a circular rotary blade which is moving while rotating at the appropriate angle necessary for cutting. In addition, the sheet material cutting mechanism of the present invention does not use a fixed blade that requires attention to the wear of the cutting edge. Further, the two rotary blades rotate while maintaining contact with each other when cutting the sheet material, so that the rotary blades are always in the state of being ground, facilitating the maintenance of sharp cutting edges. Further, a rubber roller to press a sheet material is coaxially mounted on the shaft of one of the two rotary blades, so that the sheet material to be cut is pressed by said rubber roller immediately before the sheet material is cut to prevent lifting and bending of the sheet material when it is cut, assuring a sharp cut. The sheet material cutting mechanism of the present invention has these excellent functions.

What is claimed is:

1. A sheet material cutting device comprising: a rotary blade supporting member slidably mounted on a frame; a first and a second rotary blade each having a cutting edge mounted on said supporting member; a spring member to keep the cutting edges of both said rotary blades pressed against each other; and a driving mechanism to rotate said first and second rotary blades by the movement of said rotary blade supporting member; wherein said driving mechanism comprises a first roller and a second roller, the first roller being mounted between said frame and the first rotary blade in contact with both the frame and the first rotary blade, the first roller further being mounted in a groove having a stopper formed on said rotary blade supporting member, and the second roller being mounted coaxially with the second rotary blade, having a larger diameter than that of the second rotary blade and being pressed against said frame; and wherein the first rotary blade is inclined toward the direction of movement of the supporting member when said first roller in contact with the stopper of said groove.

2. A sheet material cutting device as claimed in claim 1 wherein said rotary blade supporting member is provided with horizontally symmetrical sheet material guides.

* * * * *